United States Patent [19]

Kajiwara et al.

[11] 3,943,742

[45] Mar. 16, 1976

[54] ROLLING MILL

[75] Inventors: Toshiyuki Kajiwara; Noriyoshi Sonobe, both of Hitachi, Japan

[73] Assignee: Hitachi, Ltd., Japan

[22] Filed: Aug. 12, 1974

[21] Appl. No.: 496,828

[30] Foreign Application Priority Data

Aug. 24, 1973 Japan ..... 48-94399
Apr. 5, 1974 Japan ..... 49-37909

[52] U.S. Cl. ..... 72/247
[51] Int. Cl.[2] ..... B21B 31/18
[58] Field of Search ..... 72/247, 241–243, 72/245

[56] References Cited

UNITED STATES PATENTS 3,076,360 2/1963 Sendzimir ..... 72/242
3,818,743 6/1974 Kajiwara et al. ..... 72/243
3,857,268 12/1974 Kajiwara ..... 72/247

*Primary Examiner*—Milton S. Mehr
*Attorney, Agent, or Firm*—Craig & Antonelli

[57] ABSTRACT

A rolling mill comprising a device for moving any pair of rolls of various types axially thereof. Various types of rolls, which may be work rolls, intermediate rolls or back up rolls, are mounted in respective roll chocks disposed in a housing, and the roll chocks mounting therein any one of a pair of aforesaid rolls are slidably supported for movement axially of the rolls and in a direction in which pressure is applied to the rolls to effect rolling. The device for moving the rolls axially thereof, which may be a hydraulic pressure mechanism, is mounted in the interior of the housing or on its surfaces for moving the rolls either directly or through the associated roll chocks.

15 Claims, 8 Drawing Figures

ROLLING MILL

BACKGROUND OF THE INVENTION

1. FIELD OF THE INVENTION

This invention relates to rolling mills, and more particularly it is concerned with a rolling mill of the type in which work rolls of high rigidity are mounted in roll chocks disposed in a housing.

2. DESCRIPTION OF THE PRIOR ART

In recent years there has developed an increasing demand for producing more uniform thickness in rolled products. Advances made in the progress of art of automatically controlling strip thickness have made it possible to obtain substantially improved uniform thickness lengthwise of a metallic strip.

A program has been under way under our auspices for producing rolled products in which uniformity in thickness is maintained widthwise of the rolled product over the entire surface thereof. We have recently found that, by moving the pair of upper and lower intermediate rolls of a rolling mill axially thereof so that one end or forward end of each intermediate roll may coincide in position with the corresponding edge of strip material or may be disposed in the neighborhood thereof in order to reduce the bending of upper and lower work rolls into a barrel shape caused by a rolling load, it is possible to effect control of strip contour in the same manner as if the work rolls were backed up by back up rolls which are crowned in conformity with the width of the strip material. We have also found that it is possible to cope with a change in other rolling conditions than the width of strip material, e.g. the rate of rolling reduction, crowning of the rolls induced by heat builtup therein and the like, by axially moving the intermediate rolls. We have also found that the same effect can be obtained in a 4-high stand mill by axially moving the work rolls themselves or the back up rolls which back up the respective work rolls.

It will be understood that the inventions already made for the purpose of producing uniform thickness widthwise of rolled products call for varying the amounts of axial movements of the rolls in accordance with a change in rolling conditions, e.g. a variation in the width of strips fed to the mill, crowning of the rolls induced by heat built up therein or movement of strip material in a zigzag fashion along the pass line, or the like, which may occur both at the start of and during a rolling operation.

One example of rolling mills in which rolls are movable axially thereof is a Sendimir mill. A first intermediate roll moving means of this mill is arranged to be disposed parallel to the spindle for operating the upper and lower rolls disposed on the drive side of the mill. This arrangement makes the structure in the vicinity of the roll moving means complex. The roll moving device of the aforementioned construction would be unfit for use with a rolling mill of the large size which employs work rolls of relatively high rigidity and in which it is required to move the rolls axially thereof while a rolling operation is in progress, because such roll moving device must be of high capacity. Difficulty would be encountered in removing the spindles or effecting maintenance of the parts if the roll moving device of high capacity constructed as aforementioned were mounted in a rolling mill of the large size.

SUMMARY OF THE INVENTION

An object of this invention is to provide a rolling mill comprising a device for moving the rolls axially thereof which has a simplified construction.

Another object of the invention is to provide a rolling mill comprising a device for moving the rolls axially thereof which permits effective use of a space in the vicinity of the rolling mill.

The present invention is embodied in a rolling mill of the type in which the rolls are mounted at opposite ends thereof in roll chocks which are disposed in a housing. Thus, the rolls referred to above may mean work rolls or rolls used for backing up the work rolls, e.g. intermediate rolls or back up rolls.

The outstanding characteristics of the invention are that, in the aforementioned type of rolling mill, the roll chocks are slidably supported for movement axially of the rolls or in a direction in which pressure is applied to the rolls to effect rolling, and a device for moving the rolls is mounted in the interior of one member of the housing or on its surfaces. A preferred example of the device for moving the rolls is a hydraulic pressure mechanism which is subsequently to be described.

In mounting the roll moving device in one member of the housing, blocks each forming a part of the housing and detachably attached to the housing may be utilized, and the roll moving device may be mounted in the interior of the blocks or on surfaces thereof. In the description of the invention to be set forth hereinafter, an element will be treated as forming a part of housing proper if such element is attached to the housing proper and functions as if it were an integral part of the housing proper, even though such element constitutes an entity separate from the housing proper. A known hydraulic pressure means comprising a plurality of combinations of cylinders and pistons may be used as a typical example of the aforementioned hydraulic pressure mechanism.

EMBODIMENTS OF THE INVENTION

Figure 1:
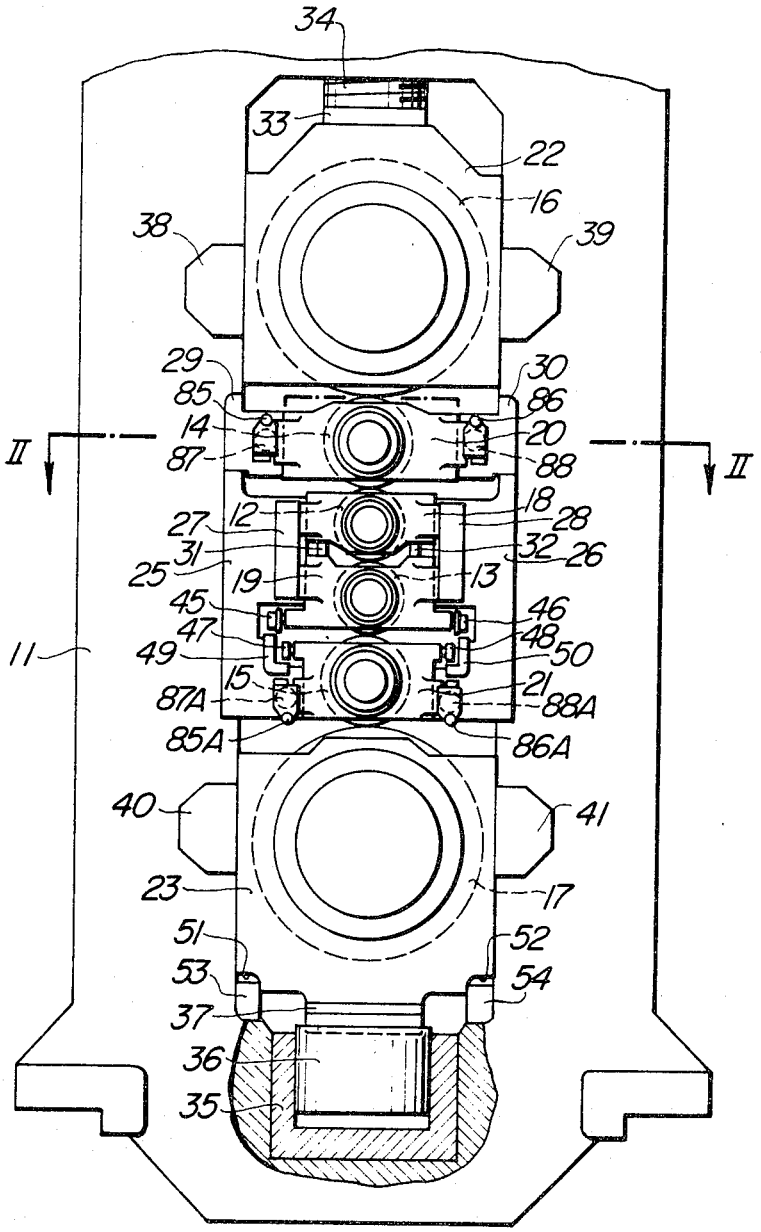
FIG. 1 is a side view of a rolling mill embodying the present invention.
Figure 2:
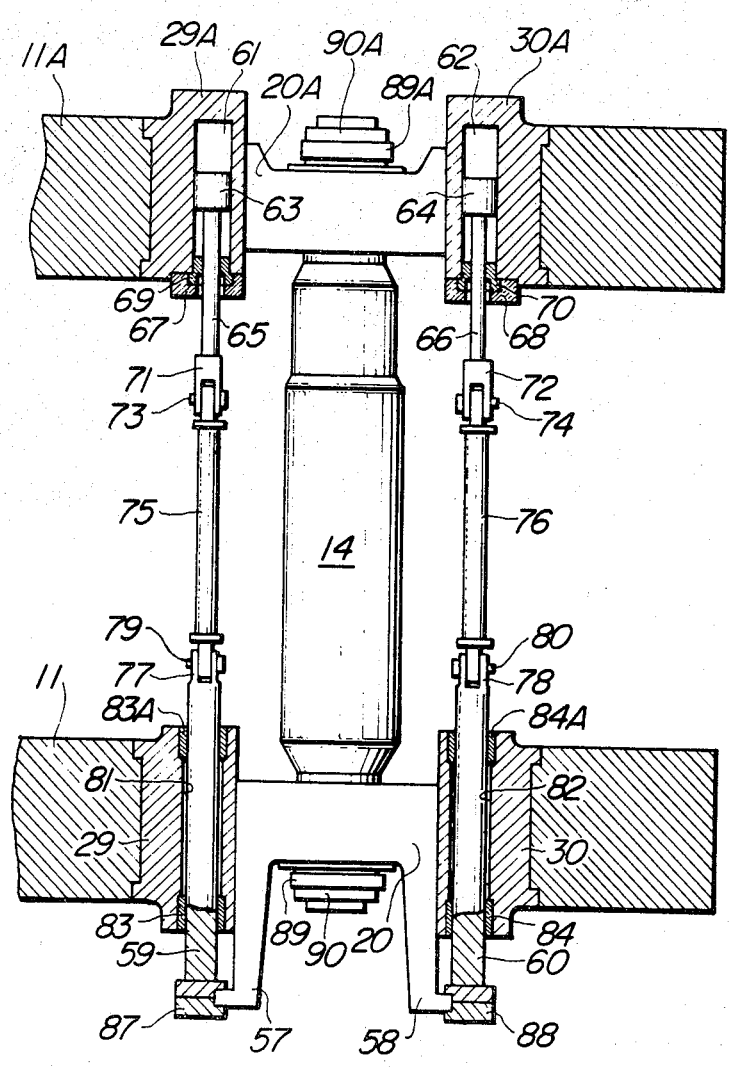
FIG. 2 is a sectional view taken along the line II—III of FIG. 1.

A first embodiment of the invention will be described with reference to the drawings. In FIG. 1 and FIG. 2, there is shown a 6-high rolling mill embodying the invention which comprises a pair of work rolls 12, 13 for effecting rolling of metallic strip material, a pair of intermediate rolls 14, 15 bearing on the work rolls 12,

13 respectively, and back up rolls 16, 17 backing up the intermediate rolls 14, 15 respectively. These rolls are disposed in a housing including housing members 11, 11A.

By moving the intermediate rolls 14, 15 in opposite directions along the axes thereof, the lengths of surfaces of rolls maintained in engagement between the intermediate rolls 14, 15 on the one hand and the work rolls 12, 13 and back up rolls 16, 17 on the other can be adjusted. This enables a varying of the zone of action of the rolling load applied to the work roll 12, 13 through the intermediate rolls 14, 15 so as thereby to prevent the application of overpressure to end portions of the rolling mill and at the same time to permit a roll bending force to be exerted on the work rolls 12, 13 without being influenced by the presence of the intermediate rolls 14, 15. The effect of this arrangement is to ensure that the prevention of bending of the work rolls 12, 13 effected by the roll bending force affects the middle portion of each work roll, thereby permitting control of the thickness of the strip widthwise thereof to be effected satisfactorily. Imparting of the roll bending force to the work rolls 12, 13 is effected by hydraulic rams 31, 32 interposed between roll chocks 18, 19 mounting the work rolls 12, 13 therein respectively.

The roll chocks 18, 19 mounting therein the work rolls 12, 13 are slidably supported for up-and-down motion in the housing on inner side surfaces of a first pair of projecting blocks 25, 26 detachably attached to the housing members 11, 11*a*. Keeper plates 27, 28 are detachably attached to the projection blocks 25, 26 respectively at the outside thereof.

The intermediate rolls 14, 15 which bear on the work rolls 12, 13 are mounted in roll chocks 20, 21 respectively. The roll chock 20 mounting therein the upper intermediate roll 14 is guided by a second pair of projection blocks 29, 30 detachably to the housing, while the chock 21 for mounting therein the lower intermediate roll 15 is guided by the first pair of projection blocks 25, 26. No keeper plates are attached to the intermediate rolls 14, 15 at the outside thereof, so that they can move axially thereof as well as in a direction in which pressure is applied to effect rolling or upwardly and downwardly in this embodiment.

The intermediate rolls 14, 15 are backed up by the back up rolls 16, 17 which are mounted at their ends in roll chocks 22, 23 respectively. A rolling force is produced by moving upwardly the lower roll chocks 23 through a plate 37 by means of hydraulic jack cylinders 35 and rams 36 mounted in a lower portion of the housing, while the upper roll chocks 22 are supported in the housing through a plate 34 and a seat 33.

As aforementioned, the upper and lower intermediate rolls 14, 15 can be moved axially thereof in order to cope with a change in the width of strip material to be rolled or other rolling conditions or maintained in a predetermined position. On the other hand, the upper and lower back up rolls 16, 17 are prevented from moving axially thereof in the housing by keeper plates 38, 39 and 40, 41 respectively, and the upper and lower work rolls 12, 13 are prevented from moving axially thereof in the housing by the keeper plates 27, 28 respectively.

The roll chock 19 is provided with wheels 45, 46 and the roll chock 21 is provided with wheels 47, 48. By causing these wheels to engage, in locking relationship, rails 49, 50 provided in the projection blocks 25, 26 respectively, the work rolls 12, 13 and intermediate rolls 14, 15 can be readily reassembled. The roll chock 23 mounting therein the lower back up roll 17 is formed therein with slide surfaces 51, 52 which can be caused to engage, in locking relationship, rails 53, 54 affixed to the housing so that the upper and lower back up rolls 16, 17 may be readily reassembled.

The operation of moving the intermediate rolls axially thereof will now be described in detail with reference to FIG. 2. As shown, the upper intermediate roll 14 is rotatably mounted at opposite ends thereof in the roll chocks 20, 20a which are assembled such that they are guided for movement up and down and axially of the rolls by the projection blocks 29, 30 and 20A, 30A attached to the housing members 11, 11A respectively. The intermediate roll 14 is connected to guide rods 59, 60 through arms 57, 58 projecting from the chock 20.

Figure 3:
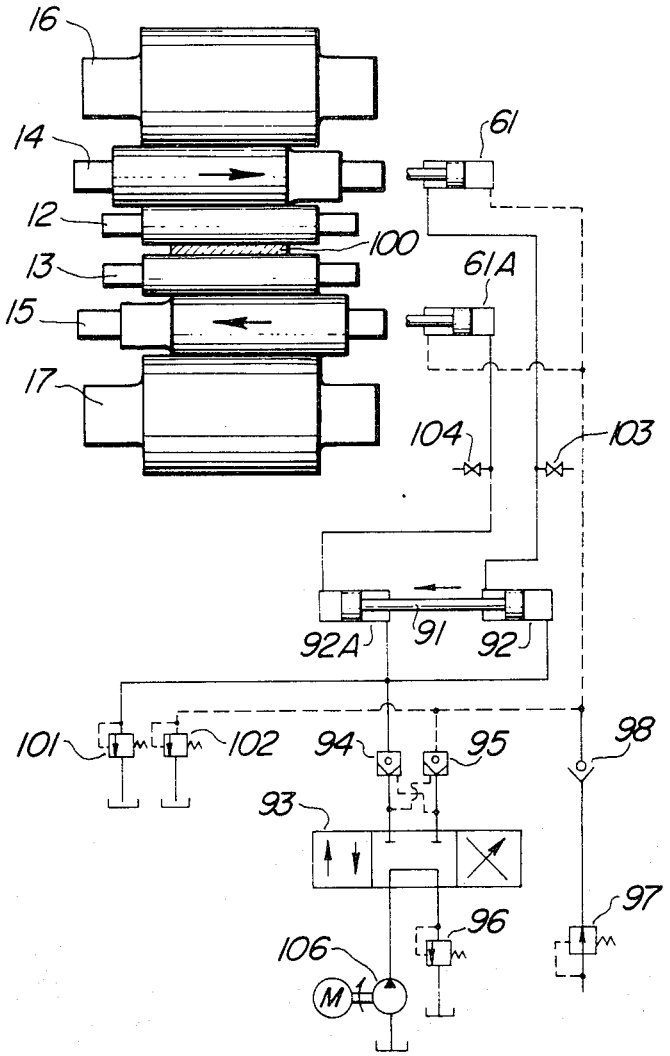
FIG. 3 is a schematic diagram showing the arrangement of various types of rolls and the circuit of hydraulic fluid for operating the cylinders for moving the intermediate rolls of a rolling mill embodying the invention.

In the embodiment shown and described, the device for moving the rolls axially thereof is hydraulically operated. Such device includes hydraulic cylinders 61, 62 mounted in the projection blocks 29A, 30A respectively which are in turn mounted in the housing member 11A on the drive side. Received in the hydraulic cylinders 61, 62 are pistons 63, 64 to which rods 65, 66 are connected respectively. Chambers in the hydraulic cylinders 61, 62 on opposite sides of the pistons 63, 64 are connected to a source of hydraulic fluid under pressure through a hydraulic pressure circuit as shown in FIG. 3. Thus, by supplying hydraulic fluid under pressure to one of the cylinder chambers on opposite sides of each piston, the pistons 63, 64 can be moved rightwardly or leftwardly in the cylinders 61, 62 respectively.

Covers 67, 68 are provided on the cylinders 61, 62 at the open side thereof, with bushes 69, 70 being mounted at the back of the covers 67, 68 respectively to provide a fluidtight seal to the cylinders 61, 62. The rods 65, 66 are formed at the forward end thereof with forked ends 71, 72 which are connected to intermediate rods 75, 76 through pins 73, 74 respectively.

The guide rods 59, 60 extend through transverse bores 81, 82 formed in the blocks 29, 30 and mounting bushes 83, 83A and 84, 84A at opposite ends thereof respectively. The arms 57, 58 are connected at the forward end thereof to the guide rods 59, 60 through connectors 87, 88 rotatably mounted on the guide rods 59, 60 at the forward end thereof through pins 85, 86 respectively. Pins 85A, 86A and connectors 87A, 88A are provided on the lower intermediate rod side.

The movement of the piston rods 65, 66 is transmitted to the roll chock 20 through the intermediate rods 75, 76 and guide rods 59, 60 which are disposed parallel to the axis of the roll 14 so as thereby to move the intermediate roll 14 axially thereof. Bearing nuts 89, 89A and half rings 90, 90A are provided at opposite ends of the intermediate roll 14.

A hydraulic pressure mechanism similar in construction to the mechanism described above is provided to the lower intermediate roll 15 for moving the same axially thereof. It is to be understood that the guide rods 59, 60 can be connected to the intermediate rods 75, 76 through other suitable means than that shown and described herein without influencing the effect obtained. The blocks 29, 30 and 29A, 30A may be eliminated, and the hydraulic cylinders 61, 62 may be formed directly in the housing or attached to the surfaces of the housing without influencing the results achieved by the invention. Assembling of the parts could be facilitated by the provision of the blocks.

Movements of the intermediate rolls axially thereof are required to be symmetrical depending on a variation in the width of a strip material 100 to be rolled as shown in FIG. 3. This can be achieved by synchronously moving the pistons through a circuit for hydraulic fluid under pressure as shown in FIG. 3. In the figure, the hydraulic cylinders 61, 61A for axially moving the intermediate rolls 14, 15 are connected, through a circuit for hydraulic fluid under pressure, to synchronizing cylinders 92, 92A interconnected by a rod 91. The circuit for hydraulic fluid under pressure can be closed by means of pilot check valves 94, 95 mounted at the entrance to the synchronizing cylinders 92, 92A and at the exit of the hydraulic cylinders 61, 61A respectively, so as to maintain the intermediate rolls 14, 15 in predetermined positions. In case there is a leak of hydraulic fluid from the circuit, fluid under lower pressure which has passed through a pressure reducing valve 97 can be supplied to the circuit through a check valve 98, so that intermediate rolls 14, 15 can be maintained in the desired positions at all times.

The operation of moving the intermediate rolls axially thereof will now be described. The hydraulic fluid under pressure supplied from a tank by actuating a pump 106 is fed to the closed circuit while operating a change-over valve 93 to maintain the check valve 95 on the return side in an open position by the pilot pressure. This causes the synchronizing cylinders 92, 92A to act such that the upper and lower pistons 61, 61A move symmetrically. A relief valve 96 mounted on the exit side of the change-over valve 93 is set at a pressure such that back pressure is applied to the pistons 61, 61A so as thereby to preclude abnormal movements of the pistons. Energy of any abnormal force which might be produced in the intermediate rolls can be absorbed by means of relief valves 101, 102 mounted in the closed circuit and set at a higher pressure. There are provided stop valves 103, 104 each for opening and closing a circuit for feeding hydraulic fluid under pressure. The stop valves 103, 104 are normally closed during the operation of the rolling mill.

The device for moving the intermediate rolls axially thereof according to the invention is constructed as aforementioned. It will be appreciated that the invention offers the advantage of being able to move the rolls axially thereof without using a mechanism of complex construction disposed in the neighborhood of the rolls. Moreover, the use of hydraulic fluid under pressure for moving the intermediate rolls and the provision of the synchronizing cylinders in the circuit for the hydraulic fluid under pressure supplied to the hydraulic cylinders for moving the rolls have the effect of moving the upper and lower rolls symmetrically.

In accordance with the invention, the aforementioned device for moving the rolls axially thereof by using hydraulic fluid under pressure can be operated electrically. When this is the case, a mechanism may be employed in which a male and female screw arrangement replaces each of the hydraulic cylinders 61, 62 and worm gears for speed reduction, motors and the like are used for moving the guide rods 59, 60 or keeping the same in desired positions. In effective symmetrical movements of the rolls, the synchronizing cylinders mounted in the circuit for hydraulic fluid under pressure may be replaced by a mechanical servomechanism.

In the embodiment shown and described, the hydraulic cylinders are disposed on the drive. It is to be understood that they may be built in the blocks disposed on the operation side in case the load, stroke and the like are low in amounts. When this is the case, maintenance and repair of the device for moving the rolls axially thereof can be facilitated.

Figure 4:
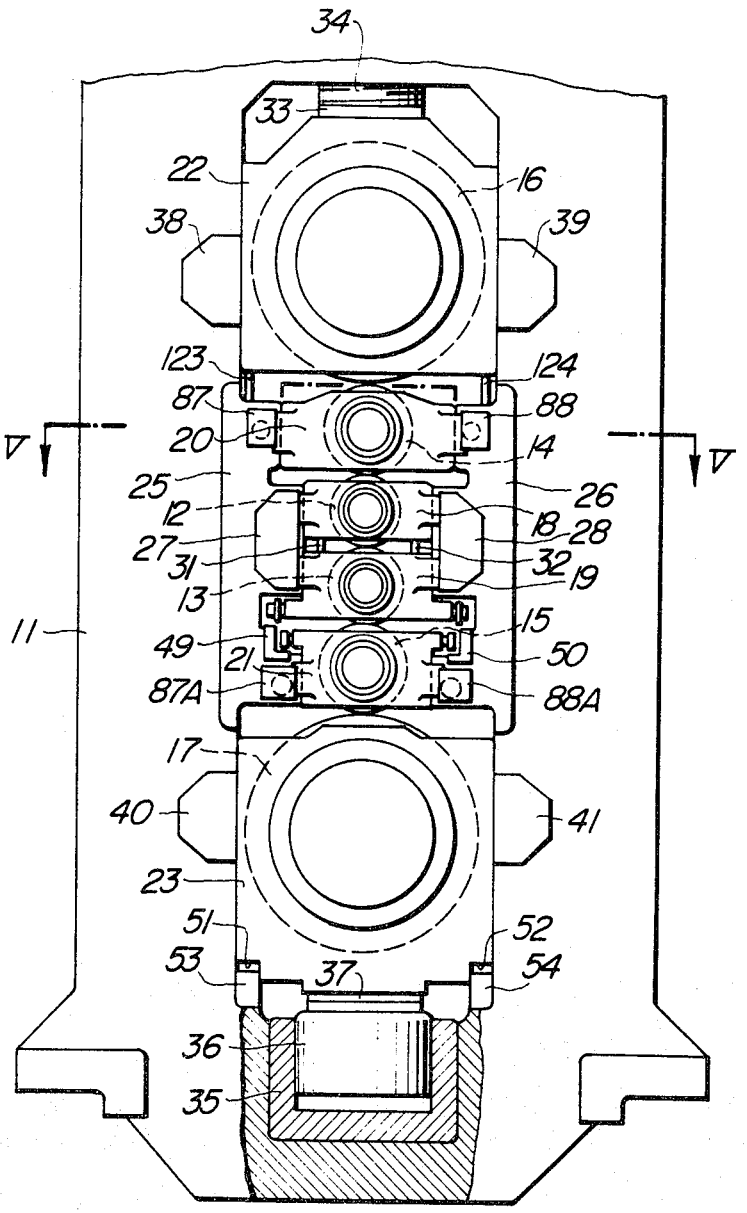
FIG. 4 is a side view of a rolling mill comprising a second embodiment of the invention.
Figure 5:
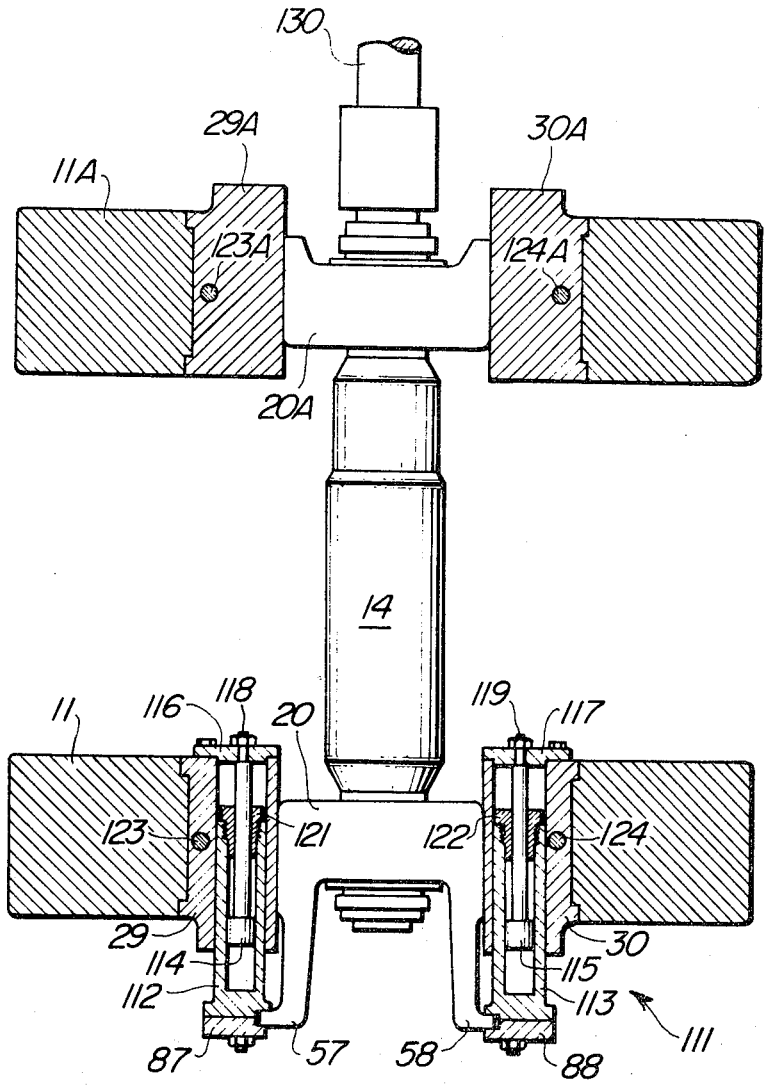
FIG. 5 is a sectional view taken along the line V—V of FIG. 4.

A modified form of the device for moving the rolls axially thereof will now be described with reference to FIG. 4 and FIG. 5 wherein parts equivalent to those shown in FIG. 1 to FIG. 3 are designated by like reference numerals. The embodiment shown in FIG. 4 and FIG. 5 is characterized by comprising a device for moving the rolls axially thereof which is built in a housing member disposed either on the operation side or drive side.

In the figures, the device for moving the rolls axially thereof is a hydraulic fluid mechanism generally designated 111 built in the housing member 11 and including hydraulic cylinders 112, 113 and pistons 114 and 115 are connected to rods secured by nuts 118, 119 to plates 116, 117 respectively which are affixed to the housing member 11. Open ends of the hydraulic cylinders 112, 113 are provided with cylinder covers 121, 122 respectively for closing the same. The arms 57, 58 are connected to the hydraulic cylinders 112, 113 at the forward end thereof. It will be understood that the forward end portions of the hydraulic cylinders serve as output shafts in this embodiment.

In this embodiment, rams 123, 124 and 123A, 124A are provided in the blocks 29, 30 and 29A, 30A respectively to move the rolls chocks mounting the upper intermediate roll 14 therein. There is provided a drive shaft 130 in the intermediate roll 14 of this embodiment for imparting a rotary drive force to the work rolls 12, 13.

Figure 6:
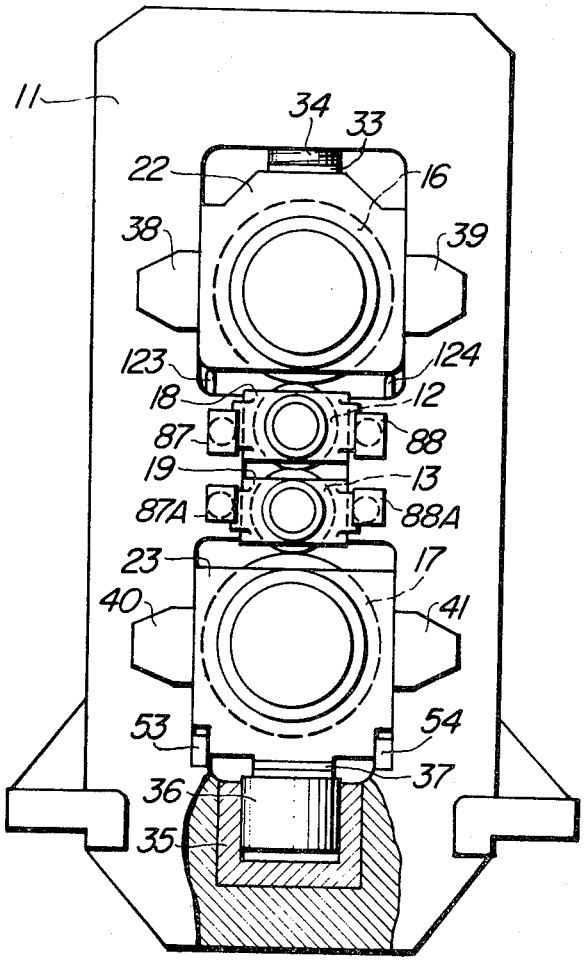
FIG. 6 is a side view of a rolling mill comprising a third embodiment of the invention.

FIG. 6 shows a 4-high rolling mill embodying the invention. In the rolling mill shown in the figure, intermediate rolls are done without and the device for moving the rolls axially thereof to effect control of the counter of strip material is mounted to act on the work rolls. Thus, the device for moving the rolls axially thereof shown in FIG. 2 is mounted in this embodiment to act on the work rolls. It will not be necessary to describe the roll moving device in detail.

Figure 7:
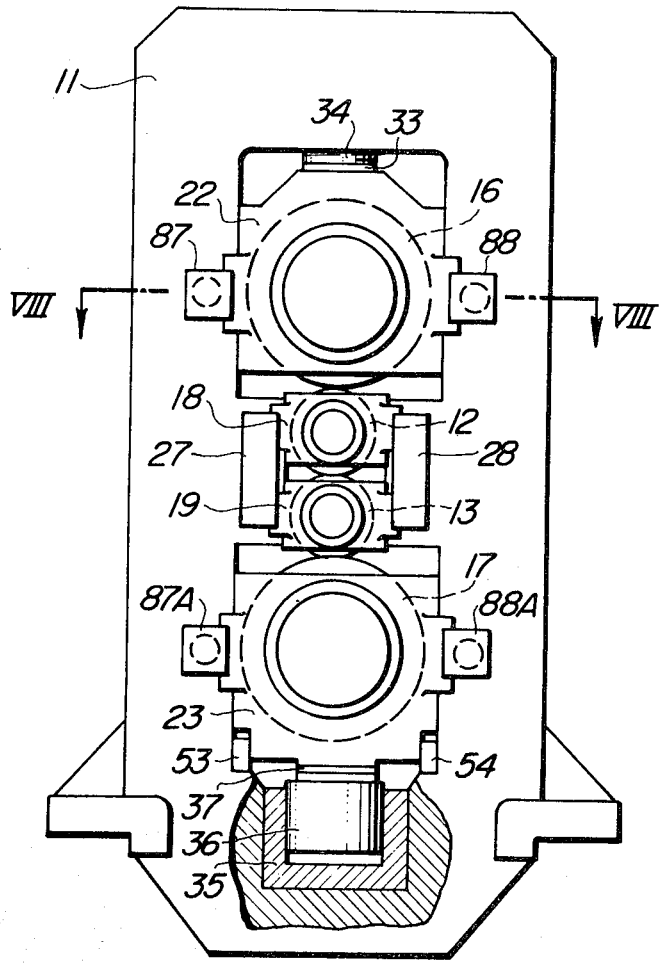
FIG. 7 is a side view of a rolling mill comprising a fourth embodiment of the invention.
Figure 8:
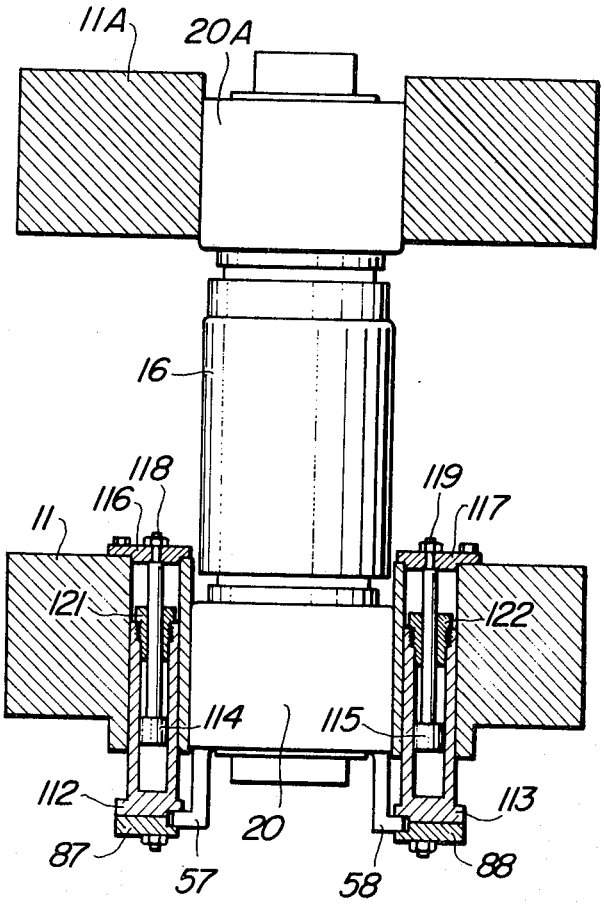
FIG. 8 is a sectional view taken along the line VIII—VIII of FIG. 7.

FIG. 7 and FIG. 8 show a 4-high rolling mill embodying the invention in which the reinforcing rolls 16, 17 are moved axially thereof in place of the work rolls 12, 13 to obtain improved uniformity in thickness widthwise of the rolled product over the entire surface thereof. The device for moving the rolls axially thereof used in this embodiment is substantially similar to that shown in FIG. 5. It is to be noted that the arms 57, 58 are affixed to the roll chocks 22 mounting the upper back up roll 16 therein. Thus, no keeper plates are provided at the outside of the roll chocks mounting the upper and lower back up rolls 16, 17 therein, so that the roll chocks for the upper and lower back up rolls are supported in the housing for movement not only up and down but also axially of the rolls.

From the foregoing description, it will be appreciated that the present invention permits intermediate rolls or other rolls to be moved axially thereof as desired without using a mechanism of complex construction disposed in the neighborhood of the rolls, particularly in the housing of the rolling mill. The device provided by the invention for moving the rolls comprises a hydraulic pressure mechanism actuated by a source of hydraulic fluid under pressure and adapted to be guided in movement by the housing itself or blocks provided in the housing as its components. Thus, the roll moving device according to the invention is compact in size and yet capable of producing high power, reliable in performance and high in efficiency.

We claim:

1. A rolling mill comprising a housing, a pair of work rolls each mounted at opposite ends thereof in roll chocks, at least one pair of rolls largers in diameter than said pair of work rolls and adapted to back up said work rolls, each of said at least one pair of larger diameter rolls also being mounted at opposite ends thereof in roll chocks, said roll chocks for at least one of said pair of work rolls and said pair of large diameter rolls being supported by blocks forming parts of juxtaposed members of the housing and detachably attached thereto, the roll chocks supporting at least one of said pair of work rolls and said pair of larger diameter rolls being slidable on surfaces of said blocks and in a direction in which pressure is applied to the rolls to effect rolling and in a direction transverse thereto, hydraulic cylinders mounted within or on surface of said blocks and each receiving a piston therein, and output shafts connected to said pistons and arranged parallel to the axes of the rolls, said output shafts each being connected to an arm affixed to either one of the roll chocks supporting said rolls whereby said rolls can be moved axially thereof by said output shafts.

2. A rolling mill as claimed in claim 1 further comprising synchronizing means mounted in a hydraulic fluid circuit for supplying hydraulic fluid under pressure to said synchronizing means being adapted to cause the pair of rolls to move axially thereof in opposite directions for the same distance.

3. A rolling mill of the type in which work rolls and other rolls backing up said work rolls are each supported at each end thereof by means of a roll chock supported by a housing having opposing housing members, characterized in that said roll chocks for said other rolls are slidably supported for movement in a direction in which pressure is applied to said other rolls to effect rolling and in a direction transverse thereto, said rolling mill further comprising means for shifting axially each of said other rolls, each of said shifting means being disposed at a position radially outwardly of the axis of said other roll and supported one of within and on said housing by at least one of said housing members, and means for connecting said shifting means to said other rolls, whereby said other rolls and their roll chocks are axially movable.

4. A rolling mill as claimed in claim 3, in which said shifting means includes a hydraulic system and an output shaft connected to said other rolls.

5. A rolling mill as claimed in claim 4, wherein the housing members include components blocks detachably attached to the housing, and said hydraulic system includes a plurality of cylinders formed in said blocks and each receiving a piston therein.

6. A rolling mill as claimed in claim 4 wherein said output shaft is connected at one end thereof to a piston so as to extend through the housing, and connected at the other end thereof to an arm affixed to one of the roll chocks.

7. A rolling mill as claimed in claim 4 wherein one of the roll chocks disposed in the member of the housing in which said hydraulic system is supported is connected to the output shaft of the hydraulic system.

8. A rolling mill as claimed in claim 3 wherein said other rolls are intermediate rols of a rolling mill in which the intermediate rolls are interposed between work rolls and back up rolls.

9. A rolling mill as claimed in claim 3 wherein said other rolls are back up rolls of a rolling mill in which said back up rolls are larger in diameter than the work rolls and back up said work rolls.

10. A rolling mill of the type in which work rolls and other rolls backing up said work rolls are supported at each end thereof by means of a roll chock supported by a housing having opposing housing members, characterized in that said roll chocks for one of said work rolls and said other rolls are slidably supported for movement in a direction in which pressure is applied to the roll associated therewith to effect rolling and in a direction transverse thereto, said rolling mill further comprising means for shifting axially one of said work rolls and said other rolls, each of said shifting means being disposed at a position radially outwardly of the axis of the associated roll and supported one of within and on said housing by at least one of said housing members, and means for connecting said shifting means to the associated roll, whereby said roll chocks and their associated rolls are axially movable.

11. A rolling mill as claimed in claim 10, wherein said roll chocks for said work rolls are axially movable with respect to said roll chocks for said other rolls.

12. A rolling mill as claimed in claim 10, wherein said roll chocks for said other rolls are axially movable with respect to said roll chocks for said work rolls.

13. A rolling mill as claimed in claim 12, wherein said other rolls are intermediate rolls of a rolling mill in which the intermediate rolls are interposed between work rolls and back up rolls.

14. A rolling mill as claimed in claim 12, wherein said other rolls are back up rolls of a rolling mill in which said back up rolls are larger in diameter than the work rolls and back up said work rolls.

15. A rolling mill is claimed in claim 10, wherein said shifting means includes hydraulic means and output shaft means disposed within the area of the housing radially outwardly of the associated roll and extending in the axial direction of the associated roll.

* * * * *